United States Patent [19]

Moehlenpah

[11] 4,198,745

[45] Apr. 22, 1980

[54] RAZOR GUARD

[76] Inventor: Walter G. Moehlenpah, 9906 Old Warson Rd., St. Louis, Mo. 63124

[21] Appl. No.: 925,456

[22] Filed: Jul. 17, 1978

[51] Int. Cl.[2] ..... B26B 19/38

[52] U.S. Cl. ..... 30/34 R; 30/90; 30/296 A

[58] Field of Search ..... 30/34 R, 90, 231, 296 A, 30/296 R

[56] References Cited

U.S. PATENT DOCUMENTS

| | | | |
|---|---|---|---|
| 942,483 | 12/1909 | Clark . | |
| 2,027,899 | 1/1936 | Bruce | 30/90 |
| 2,853,780 | 9/1958 | Bull | 30/296 R |
| 3,277,571 | 10/1966 | Bloomfield | 30/90 |
| 3,287,803 | 11/1966 | Wauters | 30/90 |
| 3,339,608 | 9/1967 | Brenner | 30/90 |
| 3,408,737 | 11/1968 | Steere et al. | 30/90 |

FOREIGN PATENT DOCUMENTS

| | | | |
|---|---|---|---|
| 718758 | 1/1944 | Fed. Rep. of Germany | 30/90 |

*Primary Examiner*—Othell M. Simpson
*Assistant Examiner*—J. T. Zatarga
*Attorney, Agent, or Firm*—Senniger, Powers, Leavitt and Roedel

[57] ABSTRACT

An elongate razor guard for holding therein a safety razor having a head, a blade carried by the head and a handle extending from the head. The guard, which grips the razor handle toward its outer end, encloses the razor head and has a curved surface engageable by corners of the razor head at the ends of the latter for preventing contact of the razor blade with the guard.

15 Claims, 5 Drawing Figures

RAZOR GUARD

BACKGROUND OF THE INVENTION

This invention relates generally to razor guards and more particularly to a razor guard for holding a safety razor having a head, a blade carried by the head and an elongate handle extending from the head.

Safety razors are commonly stored with the cutting edge of the blade exposed. This gives rise to several problems. If the razor is stored on a shelf in a medicine cabinet or the like, for example, the exposed blade presents a serious risk of injury, especially to young children. Moreover, if the razor is placed on the shelf with the cutting edge of the blade in direct contact with the shelf surface, the blade will be dulled. Similarly, if the razor is placed in a shaving (or travel) kit, the exposed blade is dangerous to one reaching into or searching through the kit. In addition, the blade may slice through the waterproof lining usually found on the inside of such kits. This not only damages the kit but also dulls the blade.

Reference may be made to U.S. Pat. No. 942,483 for a razor guard generally in the field of this invention.

SUMMARY OF THE INVENTION

Among the several objects of this invention may be noted the provision of a razor guard which securely holds a safety razor therein and encloses the razor blade for increased safety; the provision of such a guard which holds a safety razor therein in such a manner that the blade does not contact the guard, thus avoiding dulling of the blade; the provision of such a guard which is compact and easy to use; and the provision of such a guard which is simple in design for economical manufacture.

Generally, a razor guard of this invention is adapted to hold a safety razor having a head, a blade carried by the head and a handle extending from the head. This guard, which is elongate, has at one end thereof means for gripping either the razor head or the razor handle and means at its other end for holding the other of the razor head and handle in the guard. The holding means comprises a curved surface engageable by corners of the razor head at the ends of the latter for preventing contact of the cutting edge of the razor blade with the guard.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
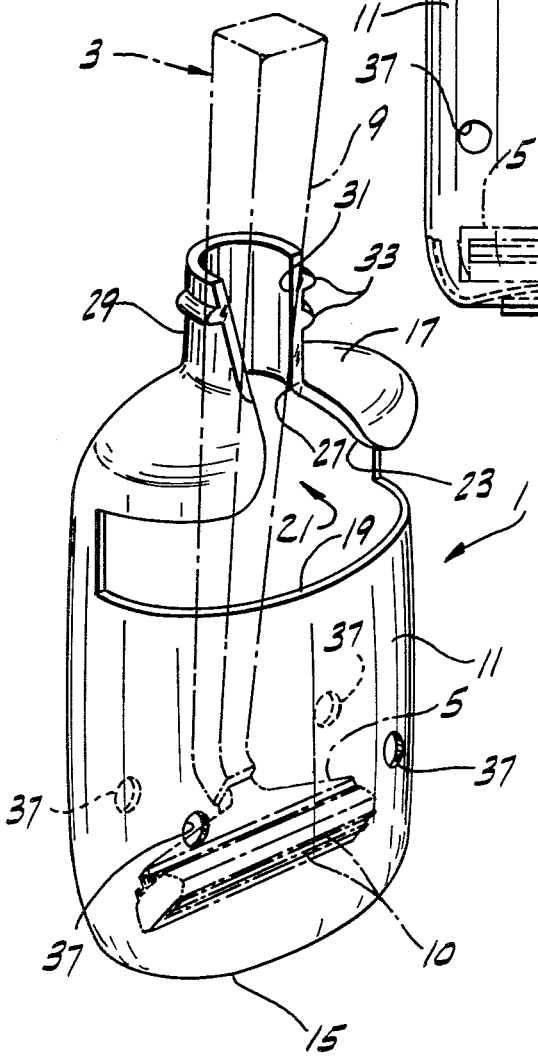
FIG. 1 is a perspective of a razor guard of this invention holding a safety razor (shown in phantom) therein.

Referring now to the drawings, first more particularly to FIG. 1, a razor guard of this invention is designated generally by the reference numeral 1 and is shown holding a safety razor 3 (in phantom) therein. This razor is of a conventional type, having a head 5, a pair of blades, each designated 7, carried by the head, and an elongate handle 9 extending from the head. Each blade 7 has a cutting edge 10 which projects from one side of head 5.

More particularly, razor guard 1, which is preferably formed of any resilient synthetic resin material, such as polyethylene, comprises an elongate container having generally rectangular front and back walls indicated at 11 and 13, respectively, and opposed end walls, the bottom end wall being designated 15 and the top end wall 17. Both the front and back walls 11, 13 are curved and the guard is generally elliptical in transverse section (see FIGS. 4 and 5). Shown affixed (as by glue) to the bottom end wall 15 of the guard is an optional bar magnet 16 constituting means for removably securing the guard to a metal cabinet or the like.

The front wall 11 of the guard has a relatively wide slot 19 therein extending transversely of the wall adjacent the top end wall 17 of the guard for insertion of razor 3 into the guard as will be explained hereinafter. In communication with this transverse slot 19, and indicated generally at 21, is a notch in the top end wall 17 of the guard. This notch 21, which extends toward back wall 13, is relatively wide at its open end 23, constituting its front end, and narrower toward its back end 25 which is sized for gripping of the razor handle 9 by the top end wall 17. The width of notch 21 at its middle, indicated at 27, is less than the width of the notch toward its back end 25, the notch thus having a generally hourglass shape.

Extending upwardly from portions of top end wall 17 bounding notch 21 is a tubular neck 29, generally circular in cross section, having therein an axial notch 31 extending the entire length of the neck at the front of the neck. The width of this axial notch decreases toward its lower end which is in communication with the middle 27 of notch 21 in top end wall 17 and is of the same width as notch 21 at that point. A rib or threads 33 extend around the neck for reinforcing it.

In accordance with this invention, safety razor 3 may readily be placed inside razor guard 1 with the longitudinal axis of the razor handle generally parallel will the longitudinal axis of the razor guard (i.e., the vertical axis of the razor guard as viewed in FIGS. 1–3) by first inserting the head 5 of the razor into the guard through the transverse slot 19 in front wall 11 and then sliding the head to a position adjacent to bottom end wall 15 of the guard. The front and back walls 11 and 13, respectively, are spaced apart but relatively close together so that on sliding the razor to this position, the handle 9 of the razor engages one of the walls (the back wall 13 as shown in the drawings) and the razor head 5 engages the opposite wall (front wall 11) to flex the walls apart (as noted above, the guard is of resilient material). Inasmuch as front wall 11 is curved, it is engaged only by the corners of the razor head 5 at points indicated at 35 in FIG. 4 when the latter is in a stored position adjacent to bottom wall 15 of the guard. Thus, the cutting edges 10 of the blades 7 do not touch any wall, thereby avoiding dulling of the blades. Moreover, the blades are completely enclosed by the guard for increased safety.

Figure 4:
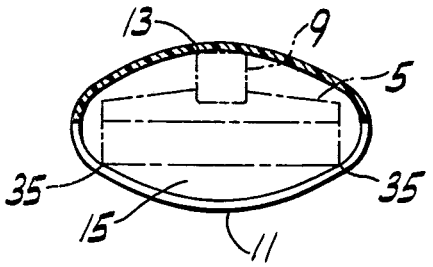
FIG. 4 is a transverse section on line 4—4 of FIG. 2.
Figure 5:
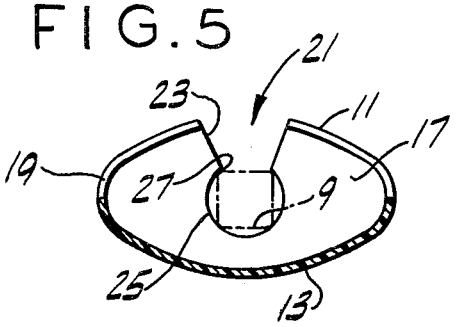
FIG. 5 is a transverse section on line 5—5 of FIG. 2.

Although it is preferable that the front and back walls 11, 13 be spaced relatively close together, as shown in the drawings, to ensure a tight fit of razor 3 in guard 1, this is not essential to the operability of this invention, and walls 11, 13 may be spaced farther apart. In that case, the walls would not flex apart on sliding razor 3 into the guard, and the corners of razor head 5 would not necessarily contact the front wall as shown in FIG. 4. In any event, it will be understood that the back wall 13 limits or restrains rearward movement of the razor head in the guard (i.e., movement away from the front wall) so as to maintain it relatively closely adjacent the front wall, the back wall thus constituting restraining means.

Although both the front and back walls 11 and 13 of razor guard 1 are preferably curved, it shall be understood that one of the walls, such as the back wall 13, for example, could be flat or planar. In such a case, however, care would have to be taken on insertion of razor head 5 into the guard that the side of the head from which the cutting edges 10 project is toward the curved front wall 11 so as to ensure that the edges 10 do not touch the guard. Of course, if a razor of the type having a cutting edge at both sides of the razor head is stored in guard 1, then both the front and back walls 11, 13 should be curved to prevent contact of the cutting edges with the walls. Safety razors designed to utilize single edge as well as double edge blades are also effectively accommodated in guards of this invention. Optionally those guards may include vent holes 37 in the front and back walls 11 and 13.

Figure 2:
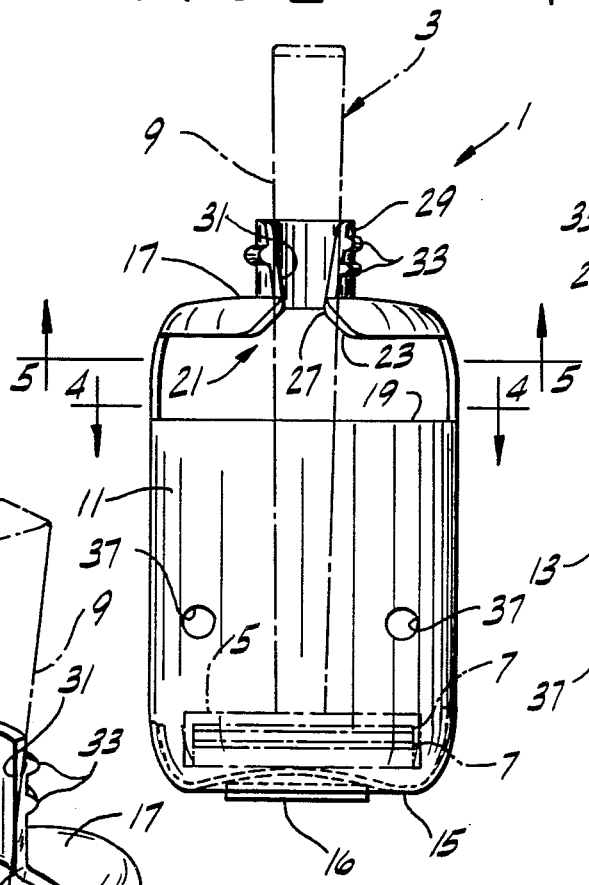
FIG. 2 is a front elevation of FIG. 1.
Figure 3:
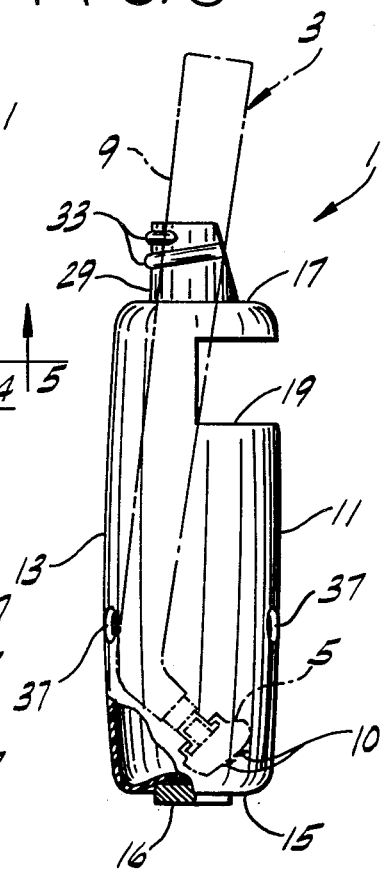
FIG. 3 is a left side elevation of FIG. 1.

With the razor head 5 in position as shown in FIGS. 1–3 adjacent the bottom end wall 15 of the guard 1, the handle 9 of the razor is then inserted into the relatively wide, front end 23 of notch 21 and then pushed in the notch toward the back wall 13 of the guard. The portions of the top end wall 17 at opposite sides of notch 21 flex apart as the razor handle 9 is pushed through the middle 27 of the notch and then spring back on insertion of the handle into the back end 25 of the notch which is sized for gripping of the handle by the top end wall 17. Similarly, as handle 9 is pushed through the axial notch 31 in neck 29, the neck expands and then snaps back on insertion of the handle into the neck which also is sized to securely grip the razor handle 9 therein. Thus, top wall 17 and neck 29 together constitute means for gripping the razor handle and holding it securely captive relative to the guard.

It will be apparent from the foregoing that the improved razor guard 1 of this invention is easy to use and compact, and that it is designed for holding a razor in a substantially fixed position within the guard for engagement of the corners of the razor head with the curved front wall, the razor blade thereby being spaced from the wall for preventing dulling of the blade. Moreover, it is simple in design for economical manufacture.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. For holding a safety razor having a head, a blade carried by the head and a handle extending from the head, an elongate razor guard of one-piece construction formed for holding the razor with the longitudinal axis of the razor handle generally parallel with the longitudinal axis of the razor guard, said guard having a surface curved for engagement solely by the corners of the razor head at the ends of the head, the razor blade thereby being spaced from the surface for preventing dulling of the blade, and means for holding the razor in a substantially fixed position relative to the guard for said engagement of the razor head with the curved surface, said holding means comprising means at one end of the guard for gripping one of the razor head and handle and means at the other end of the guard for restraining movement of the other of the razor head and handle thereby to maintain it in position relative to the guard.

2. A razor guard as set forth in claim 1 wherein said gripping means is adapted to grip the razor handle and said restraining means is adapted to maintain the razor head relatively closely adjacent said curved surface.

3. A razor guard as set forth in claim 2 having opposed generally rectangular front and back walls, each of which has a greater length than width and at least one of which is curved forming said curved surface, a first end wall closing said other end of the guard, said guard being open toward said one end allowing the head of the razor to be inserted into the guard and slid toward said first end wall to a position adjacent thereto with the razor blade being toward the curved wall, said restraining means comprising the wall opposite the curved wall and spaced therefrom for maintaining the razor head relatively closely adjacent said curved wall.

4. A razor guard as set forth in claim 3 wherein said guard is formed of resilient synthetic resin material and said front and back walls are engageable by the razor and adapted to flex apart on sliding of the razor head to said position adjacent said first end wall.

5. A razor guard as set forth in claim 3 wherein said guard is a container and both said front and back walls are curved.

6. A razor guard as set forth in claim 3 wherein said guard is generally elliptical in transverse section.

7. A razor guard as set forth in claim 3 wherein said gripping means comprises a second end wall at said one end of the guard having a notch therein extending toward the back wall of the guard, and said front wall has a slot therein extending transversely of the wall adjacent said second end wall, said slot being of sufficient length and width for passage therethrough of the head of the razor, said slot and notch being in communication with each other allowing the head of the razor to be inserted through the slot into the guard and slid lengthwise of the guard to said position adjacent said first end wall of the guard, and the handle to be inserted into said notch which is sized for gripping of the handle by the second end wall.

8. A razor guard as set forth in claim 7 wherein the notch is relatively wide at its open end, constituting its front end, allowing the razor handle to be readily inserted into the notch, and narrower toward its back end adjacent the back wall of the guard for gripping of the razor handle by said second end wall.

9. A razor guard as set forth in claim 8 wherein said guard is formed of resilient synthetic resin material.

10. A razor guard as set forth in claim 9 wherein the width of said notch at the middle thereof is less than the width of the notch toward its back end, and the portions of said second end wall at opposite sides of the notch are adapted to flex apart as the razor handle is inserted into the middle of the notch and to spring back on insertion of the handle into the back end of the notch to hold the handle captive in that end of the notch with said second end wall gripping the handle.

11. A razor guard as set forth in claim 7 wherein said gripping means further comprises a tubular neck extending from portions of said second end wall bounding said notch, said neck having an axial notch extending the entire length thereof at its front, with this axial notch being in communication with the notch in said second end wall allowing the razor handle to be inserted into the end wall notch and thence into the neck via said axial notch, said neck being sized to grip the razor handle therein.

12. A razor guard as set forth in claim 11 wherein said neck is generally circular in transverse section.

13. A razor guard as set forth in claim 11 wherein at least one rib extends circumferentially around said neck for reinforcing the latter.

14. A razor guard as set forth in claim 1 further including means for removably securing the guard to a cabinet or the like.

15. A razor guard as set forth in claim 14 wherein said means comprises a magnet affixed to the guard for magnetically securing the guard to a magnetizable portion of the cabinet.

* * * * *